US005709619A

United States Patent [19]

D'Emidio

[11] Patent Number: 5,709,619

[45] Date of Patent: Jan. 20, 1998

[54] BATTING PRACTICE DEVICE

[76] Inventor: Robert C. D'Emidio, 17 Tingley Rd., Morristown, N.J. 07960

[21] Appl. No.: 717,507

[22] Filed: Sep. 20, 1996

[51] Int. Cl.[6] ..... A63B 69/40

[52] U.S. Cl. ..... 473/424; 482/82

[58] Field of Search ..... 473/425, 424, 473/427, 108

[56] References Cited

U.S. PATENT DOCUMENTS

| | | | |
|---|---|---|---|
| 1,666,201 | 4/1928 | Goldstein | 482/82 |
| 3,731,925 | 5/1973 | Caldwell | 473/424 |
| 4,385,759 | 5/1983 | Everroad | 482/82 |
| 4,489,934 | 12/1984 | Miller | 482/82 |
| 4,564,002 | 1/1986 | Jardine | 482/82 |
| 4,577,864 | 3/1986 | Aldrich | 473/424 |
| 5,190,508 | 3/1993 | Kliewer | 482/82 |
| 5,389,086 | 2/1995 | Ricker | 482/82 |
| 5,433,435 | 7/1995 | Bourie | 473/424 |

FOREIGN PATENT DOCUMENTS

| | | | |
|---|---|---|---|
| 1106485 | 12/1955 | France | 482/82 |
| 6467 | of 1909 | United Kingdom | 482/82 |

*Primary Examiner*—Theatrice Brown

*Attorney, Agent, or Firm*—Bernard J. Murphy

[57] ABSTRACT

A centrally-bored, elongate body slidably receives rope therethrough, and a rope end tethers a ball thereat. At a handle end of the body, a clothesline tightener or foreshortener is used to clasp the handle-confined portion of the rope to prevent its movement through the body, however by withdrawal of the hollow shaft of the clothesline tightener, the rope is unclasped and can freely be drawn out of a pay out end of the handle, to lengthen the ball-tethered portion thereof, or drawn out of the handle end to foreshorten the ball-tethered portion thereof. The clothesline tightener is slidably and snugly held in the central bore of the body at the handle end thereof.

8 Claims, 1 Drawing Sheet

FIG. 1
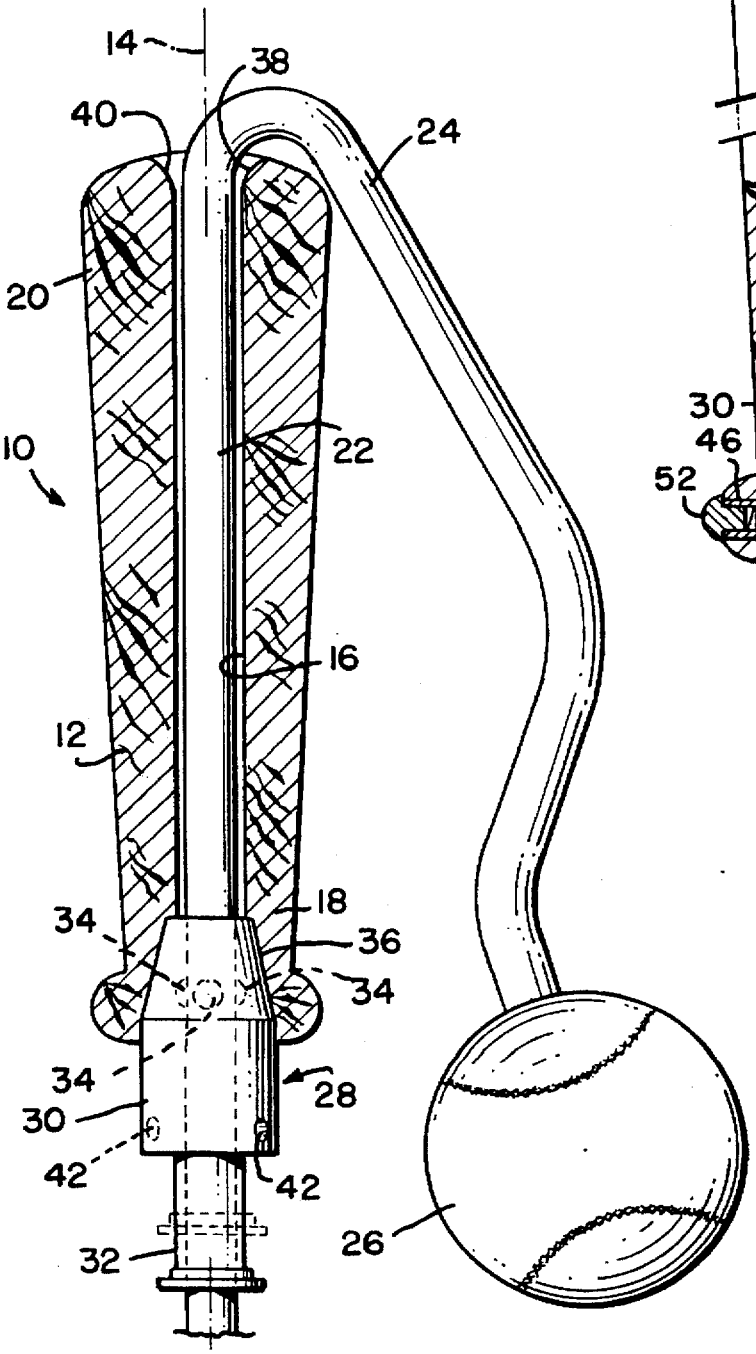
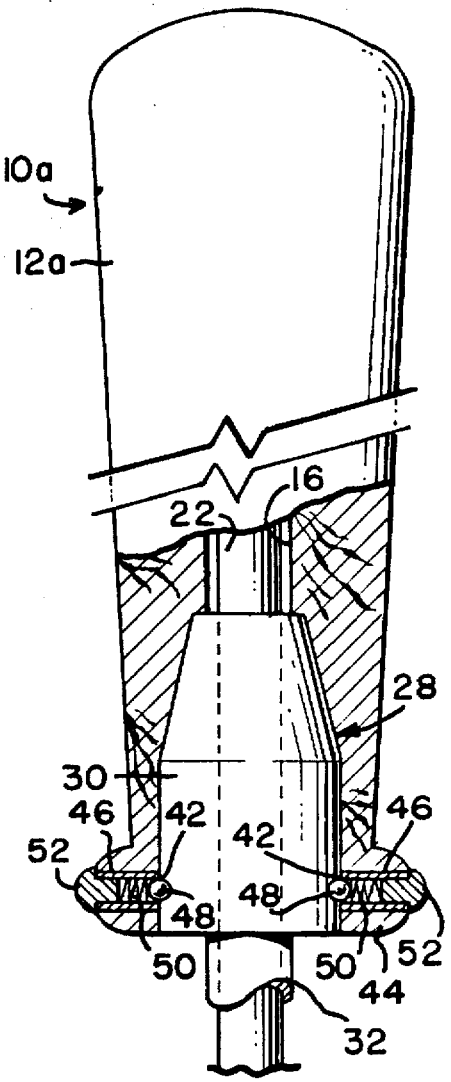
FIG. 2

BATTING PRACTICE DEVICE

This invention pertains to sporting equipment, generally, and in particular to devices useful in the practice of batting balls, i.e., baseballs and/or softballs.

Batting practice devices are well known in the prior art, and exemplary thereof are the U.S. Pat. No. 3,635,475, issued on Jan. 18th, 1972, to Dwight C. Brown; U.S. Pat. No. 2,944,817, issued to K. S. Stiller, on Jul. 12th, 1960; and especially U.S. Pat. No. 5,458,327, for a Swing Stick, granted to Michael J. Crespin, on Oct. 17th, 1995. In each of these, and other prior art devices of the same type, the rope employed with the stick or bat is of fixed length, or attached to a spring, or comprises an elastic rope. None of the aforesaid patents disclose any means for adjusting the length of the rope which can exit from the stick or bat. However, U.S. Pat. No. 3,376,037, issued for a Bat and Tethered Ball Combination, to Irving Lepselter, on Apr. 2nd, 1968, does teach a hollow bat, with a line-tethered ball, and with the line in traverse of the hollow of the bat, and in one embodiment of the patented combination, the line proceeds from a reel coupled to, and external of, the heel or handle end of the bat. Clearly, the reel accommodates the pay out of varying lengths of line and/or the retraction of line.

It is desirable to be able to control the length of rope which exits the bat or stick, as the exited length of rope determines the speed at which the tethered ball will sweep, with the swinging of the bat or stick. With the swing of the bat having a short length of rope for the ball, the ball will be sweep at a considerable speed, whereas if the length of rope is substantially extended, the speed of the ball will be correspondingly slower. When practicing with children, surely it will be necessary to move the ball relatively slow, and in practice with young adults or adults, it will be acceptable to move the ball in its sweep rapidly.

Now, the Lepselter U.S. Pat. No. 3,376,037 will accommodate adjustable lengths of rope, but it is submitted that a bat with a pendant reel, having an extending crank handle, is an ungainly article with which to work. There obtains an unmet need for a batting practice device which, in a more facile and less obtrusive manner, offers rope length adjustment. Accordingly, it is an object of this invention to set forth a batting practice device which meets the aforesaid need. Particularly, it is an object of this invention to disclose a batting practice device, comprising a body having a longitudinal axis; wherein said body has (a) a throughgoing, axial bore, and (b) a first, handle end, and a second, rope-pay out end; and a length of rope in penetration of said bore and having portions extending outwardly from said body at both ends of said body; a ball tethered to one of said rope portions, which one portion extends from said second end of said body; and means set within said bore, at said first end of said body, (a) normally operative, in a first mode of operation, for securely clasping said rope within said first end to prevent movement of said rope through said bore, and (b) selectively operative, in a second mode of operation, for unclasping said rope within said first end to permit movement of said rope through said bore.

Further objects of this invention, as well as the novel features thereof, will become apparent by reference to the following description, taken in conjunction with the accompanying figures, in which:

FIG. 1 is a cross-sectional view, taken lengthwise thereof, of a body, and rope and tethered ball with a rope clasping means, according to an embodiment of the invention; and FIG. 2 is an illustration of the handle end of the body, according to an alternative embodiment of the invention.

As depicted in FIG. 1, the novel batting practice device 10 comprises an elongated body 12 having a longitudinal axis 14 and a throughgoing, axial bore 16. The body 12 has a first, handle end 18 and a second, rope-pay out end 20. Rope 22 is in penetration of the bore 16, and has a portion 24 extending from the second end 20 with a ball 26 tethered thereto.

Within the bore 16, and at the first end 18 of the body 12 is set means 28 for controlling movement of the rope 22 through the bore 16. Means 28 is the well known clothes-line tightener or foreshortener: it has an outer shell 30 which houses a reciprocable hollow shaft 32. Shaft 32, in an end thereof, carries three balls 34 captive therein which close upon each other, as the shaft advances toward the tapered end 36 of the shell 30. Consequently, the hollow of the shaft 32 can not permit rope 22 to move therethrough; the balls 34 clasp the rope 22 and hold it against movement. A heavy spring (not shown) within the shell 30 engages the shaft 32 biasingly forcing the shaft inwardly of the shell. To provide a pathway for the rope 22, a pathway in which the rope is unclasped and can be moved through the handle end 18 of the device 10, the shaft 32 has to be pulled outwardly, relative to the shell 30. This permits the balls 34 to separate from each other, and provide access therebetween. Clearly, then, in order to pay out a desired length of rope, 22, one has only to withdraw the shaft 32, and pull rope 22 out of the pay out end 20. Upon release of the shaft 32, the aforesaid spring will-move the shaft, again, inwardly relative to the shell 30, and the balls 34 will forceably close upon the rope 22 within the end 18 securing it against further movement. Self-evidently, to foreshorten the length of rope 22 in portion 24, one has only to extract the shaft 32, and pull rope 22 out of the handle end 18. In FIG. 1, the shaft 32 is shown in (broken line illustration)its positioning when the spring is relaxed, and is shown in full line illustration to represent its positioning when it is retracted against the biasing of the spring. The clasping balls 34, shown in phantom, are represented approximately where they locate when clasping the rope 22.

To insure that there will not be undue wear of the rope 22, the body 12 is carefully configured to give the rope ample room for movement and gyration. Consequently, the bore 16 is significantly greater in diameter than the rope diameter. Additionally, the pay out end 20 of the body 12 has a widened mouth 38 formed thereat with a radiused, peripheral edge 40.

The shell 30 makes a slidable, albeit a substantially interferenced, fit within the handle end 18 of the body 12. Also, in that the body is swung, to cause the ball 26 to move in an arc (for the batter to hit), centrifugal force insures that the shell 30, and all contained therein, will remain emplaced in the body 12. However, in that the means 28, the clothes-line tightener or foreshortener, in its shell 30, has a pair of opposed apertures 42 formed therein, the same become useful in an alternative embodiment of the invention, as shown in FIG. 2. The apertures 42 are provided, in the shell 30, to receive a bail or loop to which another, complementary length of rope is secured. In the instant invention, the bail or loop is dispensed with, yet as noted, the apertures 42 therefor are employed in the FIG. 2 alternative embodiment **10*a***.

In FIG. 2, same or similar index numbers, as those in FIG. 1, represent same or similar components. The body **12*a* of the alternative embodiment 10*a*, like embodiment 10 of FIG. 1, has a prominent rim 44 formed thereon at the handle end of the body 12*a*. The rim 44 is bored through, at opposite sides thereof, to receive therein internally threaded sleeves 46. The sleeves 46 confine therewithin balls 48, springs 50, and externally threaded plugs 52. The aforesaid arrangement is so disposed as to insure that the balls 48 will engage the apertures 42 of the shell 30; the balls 48 are predetermined to be slightly larger than the apertures 42. Consequently, the balls 48 detentingly engage the shell 30, to hold the shell 30** securely in place.

The embodiments 10 and 10*a*, clearly, are useful as batting practice trainers. One person swings the device, to cause the ball 26 to sweep in an arc, and the batting practitioner attempts to hit the ball 26 as it passes before him. As noted, in a more facile and less obtrusive manner, the invention provides for the lengthening and/or foreshortening of the portion 24 of the device(s), whereby the ball 26 can be made to arc slowly or rapidly.

Nor is batting practice the only use to which the embodiments 10 and 10*a* can be put. One can set up targets: plastic bottles, blocks, and such, on elevated supports, and the user of the invention can endeavor to knock down the targets. It will be found that the further the user is from such targets, the more difficult it will be to hit and displace the targets.

While I have described my invention in connection with specific embodiments thereof, it is to be clearly understood that this is done only by way of example, and not as a limitation to the scope of the invention as set forth in the objects thereof and in the appended claims. For instance, the bodies 12 and 12*a* are shown to be of wood construction. Patently they could just as well be plastic, or metal (i.e., aluminum). Too, whereas FIG. 2 discloses an embodiment which detentingly secures the clothes-line means 28 in place, removable hardware fasteners could be employed in lieu of the detenting arrangement. These, and all other alterations and variations of the invention, as will occur to others by taking teaching from my disclosure, are deemed to be within the ambit of my invention, and embraced by the appended claims.

I claim:

1. A batting practice device comprising:

a handle body having a longitudinal axis; said body further having first and second ends and an axial bore extending therethrough;

a length of rope extending through said bore and having portion thereof extending outwardly from said body first and second ends;

a ball attached to said rope at one end thereof and the other end of said rope being spaced from said first end of said body; and manually operative means within said bore at said first end of said body for securely clasping said rope within said body to prevent movement of said rope through said bore, and for manually unclasping said rope to permit movement of said rope through said bore.

2. A batting practice device, according to claim 1, wherein: said second end of said body has a widened mouth formed therein which comprises an exit end of said bore.

3. A batting practice device, according to claim 2, wherein:

said mouth has a radiused, peripheral edge.

4. A batting practice device according to claim 1, wherein:

said manually operative means comprises a plurality of elements arrayed about said rope for movement towards said rope in a first mode of operation, and withdrawal of said elements away from said rope in a second mode of operation.

5. A batting practice device, according to claim 1, wherein:

said first end of said body has an enlarged, tapered entry formed therein;

said means comprises a complementary shell releasably inserted in said entry;

said rope extends through said shell; and said means further comprises elements positioned in said shell and about said rope.

6. A batting practice device, according to claim 1, wherein: said rope has a given diameter; and said bore has a diameter which is substantially twice said given diameter.

7. A batting practice device, according to claim 1, wherein:

said body is formed of wood.

8. A batting practice device, according to claim 1, wherein:

said first end of said body has a rim formed thereon.

* * * * *